United States Patent [19]

McDermott et al.

[11] 4,072,393

[45] Feb. 7, 1978

[54] ELECTRICAL CONNECTORS

[76] Inventors: Robert E. McDermott, 16 Munro Court, Troy, N.Y. 12180; William Golden, 1203 Fourth Ave., Watervliet, N.Y. 12189

[21] Appl. No.: 693,439

[22] Filed: June 7, 1976

[51] Int. Cl.[2] ..... H01R 11/10

[52] U.S. Cl. ..... 339/272 UC

[58] Field of Search ..... 339/244, 272, 249 B, 339/252 S, 253, 254

[56] References Cited

U.S. PATENT DOCUMENTS 3,864,005 2/1975 Klein ..... 339/272 R

FOREIGN PATENT DOCUMENTS 739,043 1/1945 Germany ..... 339/272 R 1,020,226 2/1966 United Kingdom ..... 339/272 R 592,135 9/1947 United Kingdom ..... 339/254 R

*Primary Examiner*—Joseph H. McGlynn

*Attorney, Agent, or Firm*—Cesari and McKenna

[57] ABSTRACT

An electrical connector of the resilient spring type for resiliently clamping together first and second conductors. The connector includes a frame into which a screw can be threadedly advanced. The conductor-contacting edge of the screw includes a cavity from which protrudes a coiled spring. A conductor pad has a shaft extending therefrom which is received within the coils of the spring. When the screw is tightened against the conductors, the spring is compressed. If the conductors later deform under the compressive force of the screw, the spring uncoils and forces the conductor pad to maintain a strong clamping force on the conductors.

7 Claims, 3 Drawing Figures

ELECTRICAL CONNECTORS

BACKGROUND OF THE INVENTION

This invention relates generally to electrical connectors and, more specifically, to an electrical connector of the resilient spring type and particularly adapted for use with conductors formed of a relatively soft, deformable metal such as aluminum.

Numerous electrical connector constructions are known for connecting electrical conductors to one another or to the terminals of electrical devices. In one of the more common constructions, the bared end of an electrical wire is inserted into a connector and a screw, which is threadedly received in the connector, is tightened against the wire so that the wire is held in physical contact with an opposed conductive terminal strap. For years, connectors of this type have been used quite successfully with copper or a copper alloy conductors and connector parts. However, with the introduction of lower cost aluminum conductors and connector parts, attempts to use connectors of the above type have given rise to problems.

Specifically, aluminum, though cheap, is substantially more soft and deformable than copper. Aluminum conductors or connector parts thus have a tendency to deform under the compressive force of the connector screw. This deformation, in time, can cause sufficient loosening of the connection to provide a very high resistance contact. Excess heat is then generated at the connector, which, if unchecked, can destroy the contact completely. If the loosening at the connection is sufficient, electrical arcing can also occur. In either case, not only is the reliability of the connection destroyed, but also a serious fire hazard is presented.

A variety of resilient spring type electrical connectors have previously been proposed for use with aluminum conductors or connector parts. However, none of these connectors have found wide spread commercial acceptance. Several reasons apparently account for this lack of acceptance.

Firstly, many of the proposed connectors are simply not totally effective in solving the deformation problem encountered with aluminum conductors. Connectors are known, for example, which combine a spring metal washer, a resilient pressure pad or a resilient threaded insert with a connector screw which is tightened to clamp a conductor. When the connector screw is initially tightened against the conductor, the washer, pressure pad or insert, as the case may be, is compressed. As the conductor deforms, the washer, pressure pad or insert expands to maintain electrical contact therewith. Problems arise, however, because the washers, pressure pads or inserts typically employed in these connectors have only a limited range of expansion. Thus, while the initial stages of the conductor deformation are accommodated, larger conductor deformations are not. Conductors of this type thus serve only to delay the deformation problems encountered by conventional, rigid connectors.

Other known resilient spring type connectors, while effective in accommodating conductor deformation, have relatively complex constructions. The complexity of construction adds considerably to the cost of manufacturing these connectors. Moreover, it is difficult and impractical in many cases to manufacture these complex connectors in small, compact sizes for use, for example, with small gauge wires or in electrical devices in which the available space is limited.

Finally, many known resilient spring type connectors are not structurally compatible with presently available and installed electrical devices, such as electrical meters, panel boxes and the like. To incorporate the known resilient spring type connectors in these devices would typically require detailed design and manufacturing changes in the devices themselves. These changes would best be made by the manufacturer in new, replacement devices, and even then at considerable cost. To convert already installed devices on a device-by-device basis would be impractical.

It is, therefore, a primary object of this invention to provide an improved electrical connector.

Another object of this invention is to provide an improved resilient spring type electrical connector which is particularly useful with conductors formed from a relatively soft, deformable metal such as aluminum.

Another object of the invention is to provide an electrical connector of the type described which is simple in construction and inexpensive to manufacture.

Another object of the invention is to provide an electrical connector of the type described which, when tightened against a conductor, is capable of expanding over a relatively broad range to accommodate large deformations of conductors with time.

Yet another object of the invention is to provide an electrical connector of the type described which can readily be formed into any of a wide variety of sizes.

Still another object of the invention is to provide an electrical connector of the type described which can be formed by a relatively simple modification of the rigid screw type connectors widely in use in presently installed electrical devices.

SUMMARY OF THE INVENTION

Briefly, an electrical connector embodied in accordance with the invention includes a threaded stud or screw which can be threadedly advanced into a connector frame to clamp together first and second conductors. Typically, one of the conductors is a wire and the other of the conductors is a conductive terminal strap in an electrical device. The end of the connector screw which is closer to the conductors is provided with an elongated axial cavity. A relatively strong, helically coiled spring is received in the cavity and has a length so that it protrudes from the end of the screw. A rivet is passed through a centrally located hole in a conductor pad and extends into the hollow space within the coils of the spring. The conductor pad and rivet can thus be moved axially toward the connector screw against the action of the spring.

When the connector screw is tightened against the conductor, the conductor pad and rivet force the spring to compress. If, in time, the conductor contracts due, for example, to a deformation of the conductor material, the spring resiliently uncoils and forces the conductor pad and rivet to maintain a strong clamping force on the conductor. The range of expansion of the connector may be made relatively large by using a relatively large length of coiled spring therein. The connector is thus effective in maintaining a strong clamping force on the conductor even after large scale deformations have occurred.

Many of the advantages of the invention arise because of the simplicity of the connectors which are embodied in accordance therewith and because of the ease and economy with which the connectors may be manufactured. The connectors comprise relatively few, simple-to-machine parts which are easy to assemble. The conductor pad, rivet and coiled spring combinations is such that it can be used with any of a wide variety of connector types, designs and sizes. The connectors can thus be specially manufactured for use in or with numerous electrical devices. The connectors can also be formed by converting conventional, rigid screw-type connectors. The conversion process simply involves drilling the appropriately sized cavity in the conductor-contacting end of the connector screw and adding the conductor pad, rivet and coiled spring combination thereto. It is thus possible to equip existing electrical devices withe resilient spring type connectors according to the invention without replacing or discarding the connectors now used therein. The safety and reliability of the devices can thus be significantly improved at minimal additional cost.

BRIEF DESCRIPTION OF THE DRAWINGS

The foregoing and other features and advantages of the invention will be better understood from the following detailed description taken in conjunction with the accompanying drawing in which.

DETAILED DESCRIPTION OF THE PREFERRED EMBODIMENT

Figure 1:
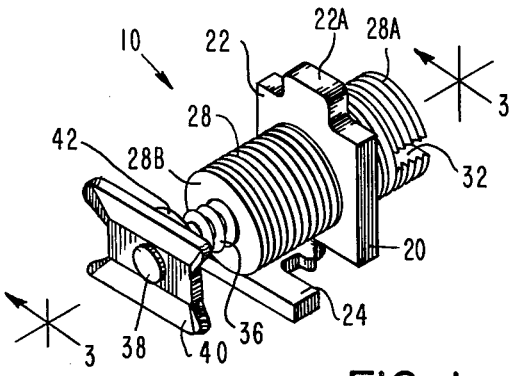
FIG. 1 is a perspective view of a connector embodying the invention in assembled form.
Figure 2:
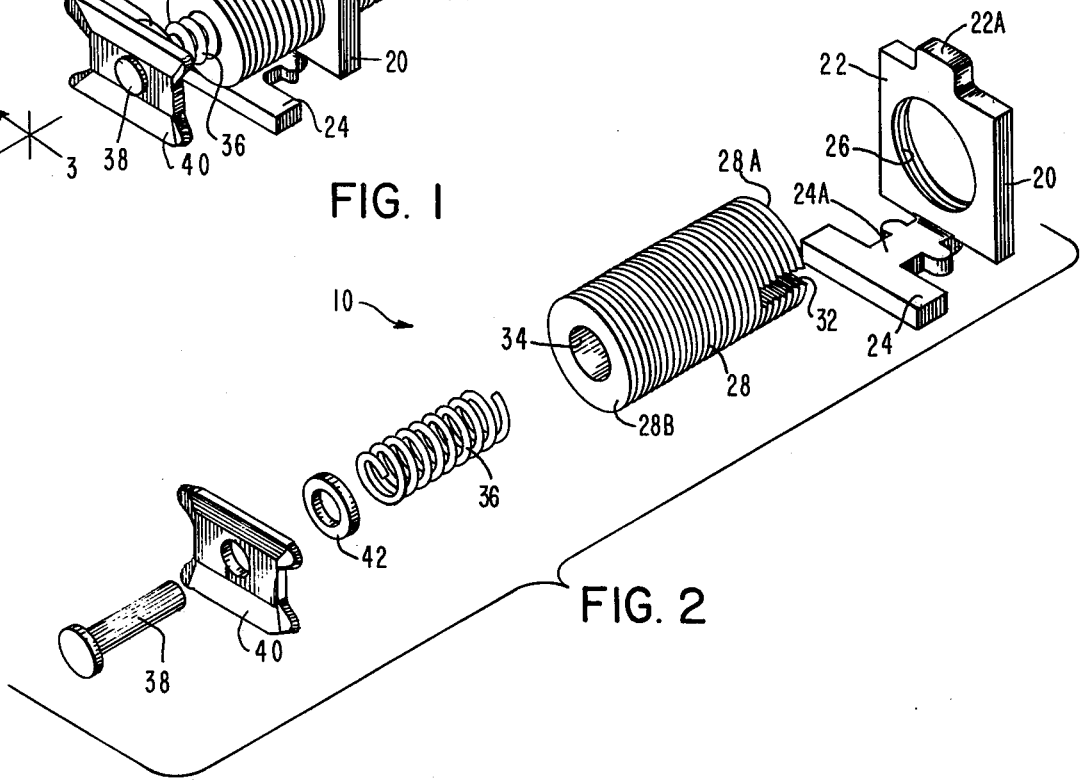
FIG. 2 is an exploded, perspective view of the connector of FIG. 1 which better illustrates the various parts thereof.
Figure 3:
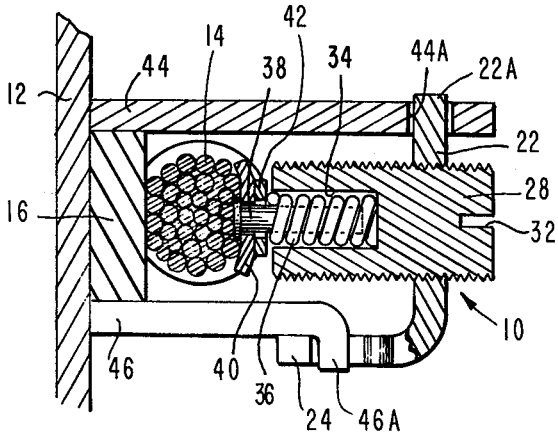
FIG. 3 is a sectional view of the connector of FIG. 1 shown in a tightened position clamping a wire conductor.

FIGS. 1, 2 and 3 show one possible embodiment of the invention in the form of a wire conductor connector 10. The connector 10 is illustratively of the type that removably fits within an electrical device, a portion of which is shown at 12 in FIG. 3. As indicated in FIG. 3, the connector 10 is used to hold a wire conductor 14 against a conductive terminal strap 16 in the device 12. The device 12 may, for example, be an electrical utility meter, a fuse or circuit breaker panel box or other electrical device.

As best seen in FIGS. 1 and 2, the connector 10 includes a connector frame 20 which consists of first and second frame members 22 and 24 respectively. The frame members 22 and 24 are illustratively integrally formed and disposed at a right angle to one another. A threaded opening 26 is provided in the first frame member 22. A connector screw 28 is threadedly received in the opening 26.

A first end 28A of the screw 28 is provided with a slot 32 which is adapted to receive the blade end of a conventional screwdriver. The screw 28 may thus be turned to move a second, opposite end 28B thereof toward or away from the frame member 22 of the connector 10.

The end 28B of the screw 28 is provided with a cylindrical cavity 34 which, as indicated in FIG. 3, extends axially into the screw 28. A helically coiled spring is inserted in the cavity 34. The spring 36 has a normal, uncompressed length that is greater than the depth of the cavity 34. Thus, with one end of the spring 36 in contact the end of the cavity 34 within the screw 28, the opposite end of the spring 36 projects from the end 28B of the screw 28. In a typical connector, the cavity 34 extends along about one half of the overall length of the screw 28, while the spring 36 has an uncompressed length between about 1.5 to 2.0 times the length of the cavity 34.

The shaft of a rivet 38 has a diameter such that is fits within the coils of the spring 36. The rivet 38 is passed through a central aperture in a conductor pad 40 before being inserted into the spring 36. Preferably, the rivet 38 is also passed through the opening of a washer 42 which is interposed between the conductor pad 40 and spring 36.

As can be appreciated from the drawings, the rivet 38 and conductor pad 40 in the connector 10 can be pressed against the action of the spring 36 toward connector screw 28. When released, however, the spring 36 forces the rivet 38 and conductor pad 40 to return to a position spaced away from the screw 28. The effective length of the connector scew 28 thus varies over a range which is determined essentially by the difference between the depth of the cavity 34 and the uncompressed length of the spring 36.

When installing the connector 10, the connector screw 28 is first preferably loosened to bring the end 28B thereof close to the connector frame 20. The connector 10 is then inserted within the device 12. In this particular embodiment, the device 12 illustratively has a pair of support members 44 and 46 which are adapted to hold the connector frame 20. Specifically, as indicated in FIG. 3, the support member 44 has a slot 44A which receives a projection 22A of the frame member 22 in the connector 10. The support member 46 has a pair of hooks (one of which is shown at 46A in FIG. 3) which straddle a neck 24A in the frame member 24. The support members 44 and 46 thereby prevent the connector frame 20 from moving to the left in FIG. 3 away from the terminal strap 16.

The bared end of the wire conductor 14 to be clamped may now be inserted between the terminal strap 16 and the conductor pad 40 of the connector 10. The connector screw 28 is then tightened against the wire conductor 14 in the usual manner. The spring 36 is compressed as the conductor screw 28 is turned toward the conductor 14. It will be noted that since the rivet 38 is free to rotate relative to the spring 36, the conductor pad 40 can be maintained stationary while the screw 28 is tightened.

If the conductor 14 and/or terminal strap 16 are formed of a relatively soft metal such as aluminum, they tend to deform with time under the compressive force of the connector screw 28. When any such deformation occurs, however, the spring 26 uncoils, forcing the conductor pad 40 to maintain physical contact with and a strong clamping force on the conductor 14. Loosening of the connection is thus prevented and the hazards of excess heat and electrical arcing are effectively eliminated.

It will be noted that the range of effectiveness of the connector 10 in accommodating deformations of the conductor 14 and/or the terminal strap 16 can be increased simply by increasing the uncompressed length of the spring 36 and the length and depth of the rivet 38 and cavity 34, respectively.

In a typical embodiment, all parts of the connector 10, with the exception of the coiled spring 36, are fabricated from cadmium, a metal which is relatively compatible with both aluminum and copper. The coiled spring 36 is preferably fabricated from tempered steel.

Conventional rigid screw type connectors often include a frame and connector screw like the frame 20 and screw 28 shown in the drawings. Typically, in such a conventional connector, a conductor pad, like the pad 40, is pinned to the end 28B of the screw 28 so that it can be held stationary while the screw is turned. It will be appreciated that such a conventional connector can readily be converted to a resilient spring type connector in accordance with the invention. Specifically, the pin holding the conductor pad 40 to the screw 28 in the conventional connector is first removed and the cavity 34 drilled into the screw 28. The spring 36, rivet 38, pad 40 and washer 42 are then simply added in the order indicated in the drawings. Since, in use, the spring 36 is compressed, the effective length of the screw 28 changes only slightly as a result of the conversion (e.g., by about the thickness of the washer 42). Because of this, the converted connector can, in most cases, be used interchangeably in the same electrical devices as the conventional rigid connector which was converted and yet possess the added reliability and safety of resiliency.

It should be understood that the above described connector is illustrative only of one specific embodiment of the invention and that numerous modifications and variations may now be realized by those skilled in the art. For example, the specific design and shape of the conductor frame 20 and screw 28 may vary widely from those shown in the figures. Instead of the slot 32, the end 28A of the screw 28 may include a polygonal recess or be shaped like a nut so that the screw can be turned by a wrench or rachet. Additionally, although the connector 10 was shown clamping the wire conductor 14 against the terminal strap 16 in the electrical device 12, the connector 10 might also be of the type used for interconnecting a pair of wire conductors. In essence, the principles of the invention apply to a wide variety of screw-type connector designs. Hence, we believe that these and other modifications are within the true spirit and scope of the invention as defined by the appended claims.

What we claim as new and desire to secure by Letters Patent of the United States is:

1. An electrical connector of the resilient spring type for clamping a first conductor against a second conductor and for resiliently expanding so as to maintain a clamping force on said first conductor in the event of the deformation of one or both of said conductors, said connector being of the type comprising a frame including means defining a threaded opening therethrough and a connector screw threadedly received in said opening, said screw being turnable relative to said frame to advance a first end thereof in a direction to force said first conductor against said second conductor, said connector being characterized by A. means defining a cylindrical cavity extending axially to a certain depth into the first end of said screw;

B. a helically coiled spring having lateral dimensions that enable it to be received in said cavity, said spring defining an interior hollow space and including a first end contacting the end of said cavity within said screw and a second, opposite end that normally protrudes from said cavity away from the first end of said screw, said spring having an uncompressed length between about 1.5 to 2.0 times the depth of said cavity; and C. conductor contacting means including i. a conductor contacting pad having lateral dimensions greater than those of said cavity, means defining a central aperture therethrough, a first side for contacting said first conductor and a second, opposite side for contacting the second, protruding end of said spring and, ii. a rivet having a shaft received in said aperture of said pad and protruding from the second side of said pad, said shaft having lateral dimensions that enable it to be received within the interior hollow space defined by said spring, said pad being pivotal about said shaft and resiliently expandable away from the first end of said screw under the action of said spring through a range determined essentially by the difference between the depth of said cavity and the uncompressed length of said spring.

2. A connector as recited in claim 1 further including a washer disposed between said spring and the second side of said pad.

3. A connector as recited in claim 1 in which the depth of said cavity is about one-half of the axial length of said screw.

4. A connector as recited in claim 1 in which said screw has a second, opposite end defining means for receiving a tool for turning said screw through said threaded opening.

5. A connector as recited in claim 1 in which said first conductor is a wire conductor and said second conductor is a terminal strap in an electrical device to which said wire conductor is to be connected, said electrical device including means for supporting the frame of said connector relative to said terminal strap.

6. A connector as recited in claim 1 in which at least one of said first and second conductors is formed from aluminum.

7. A method of converting a rigid screw connector to a resilient spring type connector that is capable of resiliently expanding so as to maintain a clamping force against deformable electrical conductors, the connector prior to its conversion comprising a frame including means defining a threaded opening therethrough and a connector screw threadedly received in the opening, the screw being turnable relative to said frame to advance a first end thereof in a direction to force a first conductor against a second conductor, said method comprising the steps of:

A. forming a cylindrical cavity extending axially to a certain depth into the first end of the screw;

B. providing a helically coiled spring defining an interior hollow space and having an uncompressed length between about 1.5 to 2.0 times the depth of the cavity and lateral dimensions that enable it to fit within the cavity;

C. inserting the coiled spring in the cavity so that a first end thereof contacts the end of the cavity within the screw and a second end thereof protrudes from the cavity away from the first end of the screw;

D. providing a conductor contacting means including a conductor contacting pad having lateral dimensions greater than those of said cavity, means defining a central aperture therethrough, a first side for contacting the first conductor and a second, opposite side and a rivet having a shaft received in the aperture of the pad and protruding from the second side of the pad, the shaft having lateral dimensions that enable it to fit within the interior hollow space of the spring, the pad being pivotal about the shaft; and E. inserting the shaft of the rivet in the interior hollow space of the spring so that the second side of the pad contacts the second, protruding end of the spring and is normally maintained spaced from the first end of the screw by the spring, the pad being resiliently expandable away from the first end of the screw under the action of the spring through a range determined essentially by the difference between the depth of the cavity and the uncompressed length of the spring.

* * * * *